US008110126B2

(12) United States Patent
Shirakawa

(10) Patent No.: US 8,110,126 B2
(45) Date of Patent: Feb. 7, 2012

(54) ELECTRICALLY CONDUCTIVE FIBER AND BRUSH

(75) Inventor: Yoshiki Shirakawa, Ehime (JP)

(73) Assignee: Teijin Fibers Limited, Osaka (JP)

( * ) Notice: Subject to any disclaimer, the term of this patent is extended or adjusted under 35 U.S.C. 154(b) by 358 days.

(21) Appl. No.: 12/407,659

(22) Filed: Mar. 19, 2009

(65) Prior Publication Data

US 2009/0226721 A1 Sep. 10, 2009

Related U.S. Application Data

(63) Continuation-in-part of application No. 11/576,966, filed as application No. PCT/JP2006/313370 on Jul. 5, 2006, now abandoned.

(30) Foreign Application Priority Data

Aug. 11, 2005 (JP) ..... 2005-232732

(51) Int. Cl.
*H01B 1/04* (2006.01)
*D01F 8/04* (2006.01)
*G03G 21/00* (2006.01)

(52) U.S. Cl. ..... 252/511; 423/447.2; 428/364; 57/901

(58) Field of Classification Search ..... 252/502, 252/511; 428/364, 370; 423/447.1, 447.2; 57/901; 399/353

See application file for complete search history.

(56) References Cited

U.S. PATENT DOCUMENTS

| | | | | |
|---|---|---|---|---|
| 3,969,559 | A | 7/1976 | Boe | |
| 4,216,264 | A | 8/1980 | Naruse et al. | |
| 5,656,686 | A * | 8/1997 | van Laak et al. | 524/495 |
| 6,413,634 | B1 | 7/2002 | Tanaka et al. | |
| 2005/0124753 | A1 | 6/2005 | Ashihara et al. | |
| 2009/0032778 | A1 | 2/2009 | Shirakawa | |

FOREIGN PATENT DOCUMENTS

| | | | |
|---|---|---|---|
| DE | 103 36 473 | A1 | 3/2005 |
| EP | 1 655 739 | A1 | 5/2006 |
| JP | 2000-160427 | A | 6/2000 |
| JP | 2001-172825 | A | 6/2001 |
| JP | 2002-235245 | A | 8/2002 |
| JP | 2004-003088 | A | 1/2004 |
| WO | 02/45098 | A2 | 6/2002 |

* cited by examiner

*Primary Examiner* — Mark Kopec
(74) *Attorney, Agent, or Firm* — Sughrue Mion, PLLC

(57) ABSTRACT

There is provided a conductive fiber containing a conductive substance, and having stable conductive performance with a small variation in its conductive performance. A conductive fiber contains carbon black as a main conductive component in a fiber-forming polymer, wherein the carbon black is composed of a mixture of at least two kinds of the following carbon blacks (A) and (B), which is obtained by mixing them at an A/B ratio (by weight) of 90/10 to 10/90: (A) a conductive carbon black having an average particle size of 20 to 70 nm and an oil absorption defined in JIS K 5101 of 100 to 600 ml/100g; and (B) a conductive carbon black in which the average article size ratio thereof to said conductive carbon black (A) is from 1.1 to 3, and the oil absorption ratio thereof to said conductive carbon black (A) is from 0.9 to 0.2.

6 Claims, 2 Drawing Sheets

[Fig. 1]
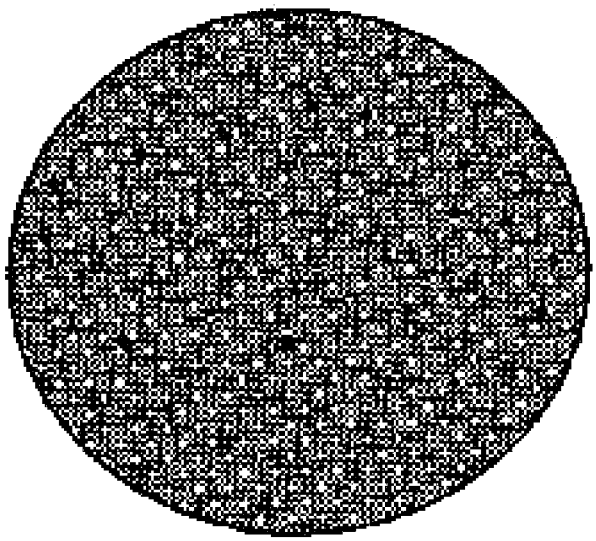
[Fig. 2]
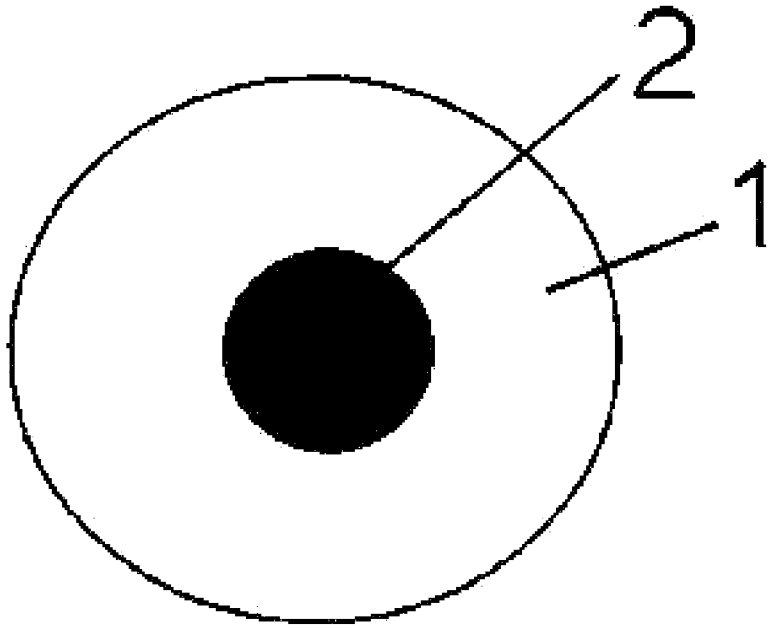

[Fig. 3]
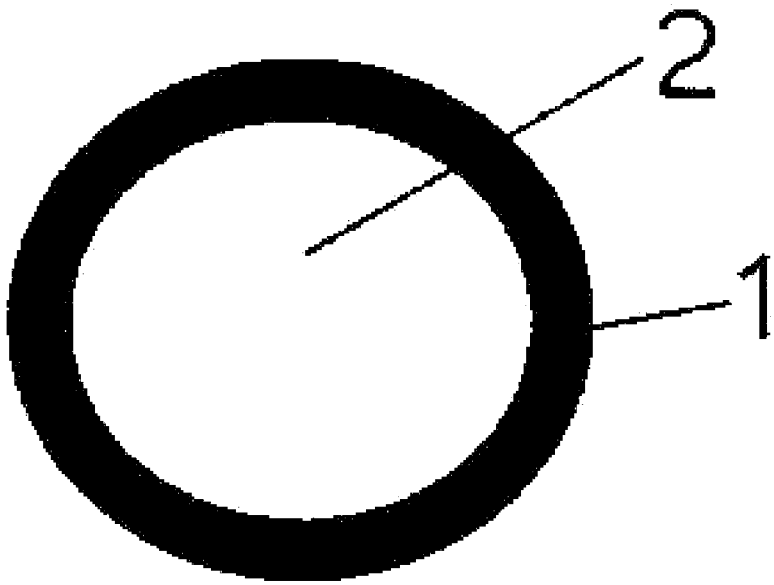
[Fig. 4]
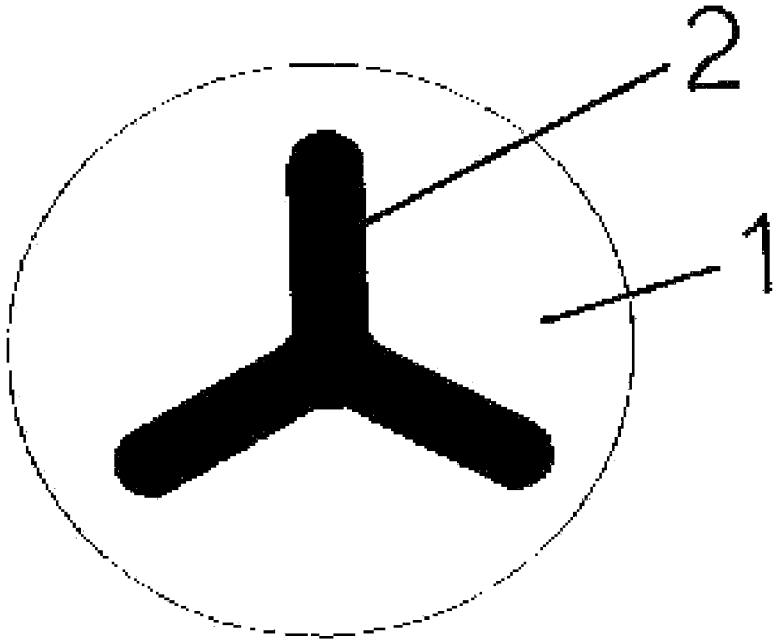

ELECTRICALLY CONDUCTIVE FIBER AND BRUSH

This application is a Continuation-In-Part of application Ser. No. 11/576,966, now abandoned, which is the national phase of PCT International Application No. PCT/JP2006/313370 filed on Jul. 5, 2006, which designated the United States and on which priority is claimed under 35 U.S.C. §120. This application claims priority under 35 U.S.C. §119(a) to Patent Application No. 2005-232732 filed in Japan on Aug. 11, 2005. The entire contents of each of the above documents is hereby incorporated by reference.

TECHNICAL FIELD

As fibers having static elimination performance, for example, conductive carbon black has hitherto been caused to be contained to impart conductive performance (patent document 1 and patent document 2). Like this, the carbon black has been widely used because of its low price and excellent conductivity. However, there has been the problem of large resistance fluctuations in the conductive resistance range of $10^8$ to $10^{12}$ Ω/cm, namely in a so-called middle to high resistance region. This is caused by a conductivity expression mechanism of the carbon black. When the carbon black is low in concentration, it has no conductivity. However, when it exceeds a certain degree of concentration, conductivity is rapidly expressed. Accordingly, the above-mentioned conductive resistance range of $10^8$ to $10^{12}$ Ω/cm just corresponds to between the expression of conductivity and the saturation thereof, and there has been the problem of the easy occurrence of fluctuations in conductivity of the carbon black even when the carbon black has the same concentration.

[Patent Document 1] JP-A-2005-194650

[Patent Document 2] JP-A-2006-9177

DISCLOSURE OF THE INVENTION

Problems that the Invention is to Solve

An object of the present invention is to provide a conductive fiber containing conductive carbon black as a conductive substance, which fiber has small fluctuations in conductive performance and stable conductive performance.

Means for Solving the Problems

The present invention relates to a conductive fiber containing carbon black as a main conductive component in a fiber-forming polymer, wherein the carbon black is composed of a mixture of at least two kinds of the following carbon blacks (A) and (B), which is obtained by mixing them at an A/B ratio (by weight) of 90/10 to 10/90:

(A) A conductive carbon black having an average particle size of 20 to 70 nm and an oil absorption defined in JIS K 5101 of 100 to 600 ml/100 g; and (B) A conductive carbon black in which the average particle size ratio thereof to the above-mentioned conductive carbon black (A) is from 1.1 to 3, and the oil absorption ratio thereof to the above-mentioned conductive carbon black (A) is from 0.9 to 0.2.

Here, the cross-sectional resistance value of the above-mentioned conductive fiber is preferably from $10^8$ to $10^{12}$ Ω/cm.

Further, the conductive fiber of the present invention is preferably a sheath-core type composite fiber.

When the conductive fiber is the sheath-core type composite fiber, it is preferred that the core component contains the mixture of at least two kinds of carbon blacks (A) and (B) in an amount of 10 to 35% by weight.

Further, when the conductive fiber is the sheath-core type composite fiber, the sheath component may contain the mixture of at least two kinds of carbon blacks (A) and (B) in an amount of 10 to 35% by weight.

On the other hand, the conductive fiber of the present invention may be a fiber in which the mixture of at least two kinds of carbon blacks (A) and (B) is homogeneously blended with the fiber forming polymer acting as a matrix component in an amount of 10 to 35% by weight to form the whole cross section of the fiber as a conductive component.

Next, the present invention relates to a brush using the above-mentioned conductive fiber.

ADVANTAGES OF THE INVENTION

The conductive fiber of the present invention contains the carbon black having at least two kinds of characteristics at the time of imparting conductivity, thereby being able to provide the conductive fiber having a more stable resistance value.

BRIEF DESCRIPTION OF THE DRAWINGS

FIG. 1 is a schematic cross sectional view of a conductive fiber of the present invention.

FIG. 2 is a schematic cross-sectional view of another conductive fiber of the present invention.

FIG. 3 is a schematic cross sectional view of still another conductive fiber of the present invention.

FIG. 4 is a schematic cross sectional view of a further conductive fiber of the present invention.

DESCRIPTION OF REFERENCE NUMERALS AND SIGNS

1: Sheath Component

2: Core Component

BEST MODE FOR CARRYING OUT THE INVENTION

In the conductive fiber of the present invention, matrix polymers with which conductive carbon black is mixed include fiber-forming polymers such as nylon 6, nylon 6,6, polyethylene, polypropylene and a polyester such as polyethylene terephthalate. These matrix polymers may be copolymerized with a third component, and may contain a delustering agent such as titanium dioxide. For example, when the polyester is used as the matrix polymer, copolymerization of isophthalic acid or adipic acid in an amount of about 10 to 20 mol % based on the whole acid components is preferred in terms of fiber-making properties. Further, ethylene glycol may be changed to a glycol component such as trimethylene glycol, tetramethylene glycol, 1,5-pentanediol or 1,6-hexanediol, or such a glycol component may be copolymerized.

Further, the conductive fiber of the present invention may be either a fiber composed of the single polymer shown above or a sheath-core type composite fiber. In this case, the conductive component may be arranged in either a core or a sheath. In either case of the composite fiber, the ratio of the conductive component is usually in the range of 10 to 20% by weight of the whole fiber in terms of fiber-making properties and cost.

When the core is formed of the conductive component, fiber-making properties and fiber strength are particularly excellent. Further, when the delustering agent is caused to be contained in the sheath polymer, excellent aesthetic properties are preferably obtained. On the other hand, when the conductive component is arranged in the sheath, it is preferred in that the value of surface resistance of the conductive fiber is equalized. A polymer other than the conductive component is herein composed of a fiber-forming polymer. The fiber-forming polymers include, for example, a polyester, nylon 6, nylon 6,6, propylene and the like. However, the polyester, especially polyethylene terephthalate, is preferred particularly interms of good texture, excellent handling properties in a processing process and good chemical resistance. Further, although the polyester is characterized in that the stiffness of the fiber is high compared to nylon and the like, the good results of improving toner scraping properties are obtained particularly by adjusting the Young's modulus to 70 cN/dtex or more when the fiber is used as a brush used in a copying machine.

The conductive fiber of the present invention is caused to contain carbon black in order to impart conductivity. As the conductive carbon black, there can be used known one, for example, acetylene black, oil furnace black thermal black channel black, Ketchen black or carbon nanotubes. These can be usually dispersed in matrix polymers to use. As the matrix polymers, the above-mentioned various fiber-forming polymers are used.

In order to obtain the conductive fiber of the present invention, it is important that the carbon black used as the conductive component is a mixture of at least two or more kinds of carbon blacks each having different characteristics.

First, the average particle size of one carbon black (A) is from 20 to 70 nm, and preferably from 30 to 60 nm. When the average particle size is less than 20 nm, it is difficult to homogeneously disperse the carbon black in the matrix polymer, resulting in a decrease in process yield such as an increase in yarn breakage due to coagulation at the time of fiber making. On the other hand, when the average particle size exceeds 70 nm, a larger amount of carbon black becomes necessary for obtaining desired conductive performance, as well as the problem of yarn breakage at the time of fiber making. This is also unfavorable in cost.

Further, the oil absorption of carbon black (A), which is defined in JIS K 5101, is from 100 to 600 ml/100 g, and preferably from 150 to 300 ml/100 g. When the oil absorption is less than 100 ml/100 g, the structure of the carbon black excessively develops, resulting in a decrease in process yield such as an increase in yarn breakage due to a decrease in fluidity. On the other hand, when it exceeds 600 ml/100 g, the degree of development of the structure is low, so that a large amount of carbon black becomes necessary for expressing conductivity. This unfavorably causes a cost rise.

The above-mentioned conductive carbon black (A) can be used either alone or as a combination of two or more thereof.

Commercial products of conductive carbon black (A) include "Ketchen Black" manufactured by Mitsubishi Chemical Corporation such as "EC300J" (average particle size:39.5 nm) and "EC600JD" (average particle size:34.0 nm), "TOKABLACK™" manufactured by Tokai Carbon Co., LTD. such as "#5500" (average particle size:25 nm), "#4500" (average particle size:40 nm), "#4400" (average particle size:38 nm) and "#4300" (average particle size:55 nm) and "Denka Black" manufactured by Denki Kagaku Kogyo Kabushiki Kaisha such as "FX-35" (average particle size:26 nm) and "HS-100" (average particle size:48 nm), and the like.

When the carbon black is formed of a single characteristic component, there has been the problem of the easy occurrence of fluctuations in a resistance value in a middle to high resistance region such as the conductive resistance range of $10^8$ to $10^{12}$ Ω/cm. This is caused by a conductivity expression mechanism of the carbon black. When the carbon black is low in concentration, it has no conductivity. However, when it exceeds a certain degree of concentration, conductivity is rapidly expressed, and a further increase in the amount added results in saturation. This region just corresponds to an intermediate portion of this behavior, which causes the occurrence of fluctuations in a resistance value. In order to solve this problem, at least two or more kinds of carbon blacks each having different characteristics are blended in the present invention, thereby more stabilizing the resistance value.

That is to say, in the present invention, conductive carbon black (B) in which the average article size ratio thereof to the above-mentioned conductive carbon black (A) is from 1.1 to 3, and the oil absorption ratio thereof to the above-mentioned conductive carbon black (A) is from 0.9 to 0.2 is blended, thereby stabilizing the conductive resistance. When the average particle size ratio is less than 1.1, there is no effect of stabilizing the conductive resistance. Accordingly, it is necessary to blend the carbon black having an average particle size ratio of 1.1 or more. On the other hand, when the ratio exceeds 3, fiber-making performance extremely decreases.

Further, for the oil absorption, when the ratio exceeds 0.9, there is little difference in the degree of development of the structure, resulting in no effect of stabilizing the conductive resistance. On the other hand, less than 0.2 does not contribute to conductivity so much, and no effect is observed.

The above-mentioned conductive carbon black (B) can be used either alone or as a combination of two or more thereof.

Commercial products of conductive carbon black (B) include "Ketchen Black" manufactured by Mitsubishi Chemical Corporation such as "EC300J" (average particle size: 39.5 nm) and "EC600JD" (average particle size: 34.0 nm), "TOKABLACK™" manufactured by Tokai Carbon Co., Ltd. such as "#5500" (average particle size: 25 nm), "#4500" (average particle size: 40 nm), "#4400" (average particle size: 38 nm) and "#4300" (average particle size: 55 nm) and "Denka Black" manufactured by Denki Kagaku Kogyo Kabushiki Kaisha such as "FX-35" (average particle size:26 nm) and "HS-100" (average particle size:48 nm), and the like.

Then, for the mixing ratio of conductive carbon black (A) and conductive carbon black (B), the (A)/(B) ratio (by weight) is usually from 90/10 to 10/90, and preferably from 30/70 to 70/30 although it depends on a desired resistance region. When they are blended in this range, the conductive resistance is stabilized. The reason for this is not clear at the present time. However, it is believed that the behavior of changes in electric conductivity to the amount of carbon blacks added becomes slow, compared to the case where the carbon black is singly used, by blending the carbon blacks different in particle size and structure development.

Further, the carbon black comprising the above-mentioned components (A) and (B) to be blended with the conductive component is added preferably in an amount of 10 to 35% by weight, and more preferably in an amount of 10 to 25% by weight. Less than 10% by weight results in no increase in electric conductivity, whereas exceeding 35% by weight results in poor fluidity, which is unfavorable in terms of a fiber-making process. The amount of the conductive carbon black added is appropriately adjustable depending on the kind of carbon black used.

Examples of cross sectional views of the conductive fibers of the present invention are shown in FIGS. 1 to 4.

Of these, FIG. 1 shows the conductive fiber in which the conductive carbon black mixture comprising at least two kinds of components (A) and (B) is homogeneously blended with the fiber forming polymer acting as a matrix component to form the whole cross section of the fiber as a conductive component.

Further, FIGS. 2 to 4 show examples of the sheath-core type conductive composite fibers, wherein the reference numeral 1 denotes a sheath component, and the reference numeral 2 denotes a core component. FIGS. 2 and 4 show examples in which a conductive component is disposed as the core component, and FIG. 3 shows an example in which a conductive component is disposed as the sheath component. When the conductive component is disposed as the core component, the core component may be in modified cross section as shown in FIG. 4. In that case, for a tapered tip portion thereof, it is necessary that the ratio of a portion in which the core component is not covered with the sheath component is 5% or less of the whole periphery of the sheath component. If the ratio of the portion in which the core component is not covered with the sheath component exceeds 5%, the core and the sheath are separated from each other, or the conductive carbon black component drops off, resulting in a high possibility of causing contamination.

In the case of the conductive fiber shown in FIG. 1, the mixture of at least two kinds of the above-mentioned carbon blacks (A) and (B) is homogeneously blended with the fiber forming polymer acting as a matrix component in an amount of 10 to 35% by weight to form the whole cross section of the fiber as a conductive component.

Further, in the case of the sheath-core type composite fibers shown in FIGS. 2 and 4, the mixture of at least two kinds of the above-mentioned carbon blacks (A) and (B) is caused to be contained in the core component in an amount of 10 to 35% by weight.

Furthermore, in the case of the sheath-core type composite fiber shown in FIG. 3, the mixture of at least two kinds of the above-mentioned carbon blacks (A) and (B) may be caused to be contained in the sheath component in an amount of 10 to 35% by weight.

The conductive fiber of the present invention has static elimination performance excellent in fiber physical properties and durability in actual use, and can be suitably used as charging brushes, static eliminating brushes and cleaning brushes incorporated in OA equipment such as copying machines and printers.

Such a brush having static elimination performance is obtained, for example, by weaving the conductive fiber of the present invention as a pile fabric, backing it with a backing agent having conductivity, and then, wrapping a pile tape cut to a width of 10 to 30 mm around a cylindrical metal rod, or simply adhering the pile fabric to a plate to make it in brush form.

EXAMPLES

The present invention will be illustrated in greater detail with reference to the following examples, but the invention should not be construed as being limited thereto.

(a) Oil Absorption

The oil absorption was measured based on JIS K 5101.

(b) Average Particle Size

The average particle size of carbon black was measured using a laser diffraction type size distribution measuring apparatus, SALD-200V ER, manufactured by Shimadzu Corporation.

(c) Strength and Elongation of Fiber

The strength and elongation of a fiber was measured based on JIS L 1013.

(d) Internal Electric Resistance Value between Fiber End Faces

This is hereinafter referred to as the "cross-sectional resistance value". Both ends of a fiber were cut in a cross-sectional direction to a length in a fiber axis direction of 2.0 cm, and Ag Dotite (a conductive resin paint containing silver particles; manufactured by Fujikura Kogyo KK) was adhered to both the cross sections of the fiber. On an electrically insulating polyethylene terephthalate film, a direct current voltage of 1 KV was applied using the Ag Dotite-adhered faces under conditions of a temperature of 20° C. and a relative humidity of 40%. A current flowing between both the cross sections was determined, and the electric resistance value (Ω/cm) was calculated according to Ohm's law.

Example 1

As conductive substances, 10 parts by weight of conductive carbon black (A) ("Denka Black FX-35" manufactured by Denki Kagaku Kogyo Kabushiki Kaisha) having an average particle size of 26 nm and an oil absorption of 220 ml/100 g and 9 parts by weight of conductive carbon black (B) ("Denka Black HS-100" manufactured by Denki Kagaku Kogyo Kabushiki Kaisha) having an average particle size of 48 nm and an oil absorption of 140 ml/100 g were blended with 81 parts by weight of polyethylene terephthalate copolymerized with isophthalic acid in an amount of 15 mol %. Melt extrusion was performed using this composition as a core component and polyethylene terephthalate as a sheath component at a weight ratio of 10/90 to obtain a sheath-core type composite filament yarn of 50 dtex/24 filaments having a cross section as shown in FIG. 2. This operation was repeated three times to obtain 3 composite filament yarns, for each of which the cross-sectional resistance value was measured. As a result, the resistance value was in the range of $5\times10^9$ to $9\times10^9$ Ω/cm to show a small variation. Thus, good results were obtained.

Comparative Example 1

As a conductive substance, 15 parts by weight of conductive carbon black (A) ("Denka Black FX-35" manufactured by Denki Kagaku Kogyo Kabushiki Kaisha) having an average particle size of 26 nm and an oil absorption of 220 ml/100 g was blended with 85 parts by weight of polyethylene terephthalate used in Example 1. Melt extrusion was performed using this composition as a core component and polyethylene terephthalate as a sheath component at a weight ratio of 10/90 to obtain a sheath-core type composite filament yarn of 50 dtex/24 filaments having a cross section as shown in FIG. 2. This operation was repeated three times to obtain 3 composite filament yarns, for each of which the cross-sectional resistance value was measured. As a result, the resistance value was in the range of $5\times10^9$ to $7\times10^{10}$ Ω/cm to show a variation.

INDUSTRIAL APPLICABILITY

The conductive fiber of the present invention contains conductive carbon black as a conductive substance, and has stable conductive performance with a small variation in its conductive performance, so that it has static elimination performance excellent in fiber physical properties and durability in actual use, and can be suitably used as charging brushes, static eliminating brushes and cleaning brushes incorporated in OA equipment such as copying machines and printers.

The invention claimed is:

1. A conductive fiber containing carbon black as a main conductive component in a fiber-forming polymer, wherein the carbon black is composed of a mixture of at least two kinds of the following carbon blacks (A) and (B), which is obtained by mixing them at an A/B ratio (by weight) of 90/10 to 10/90:

(A) A conductive carbon black having an average particle size of 20 to 70 nm and an oil absorption defined in JIS K 5101 of 100 to 600 ml/100 g; and (B) A conductive carbon black in which the average article size ratio thereof to said conductive carbon black (A) is from 1.1 to 3, and the oil absorption ratio thereof to said conductive carbon black (A) is from 0.9 to 0.2, wherein the mixture of at least two kinds of carbon blacks (A) and (B) is homogeneously blended with the fiber forming polymer acting as a matrix component in an amount of 10 to 35% by weight to form the whole cross section of the fiber as a conductive component.

2. The conductive fiber according to claim 1, wherein the cross-sectional resistance value is from $10^8$ to $10^{12}$ Ω/cm.

3. A brush using the conductive fiber according to claim 2.

4. A brush using the conductive fiber according to claim 1.

5. A conductive fiber containing carbon black as a main conductive component in a fiber-forming polymer, wherein the carbon black is composed of a mixture of at least two kinds of the following carbon blacks (A) and (B), which is obtained by mixing them at an A/B ratio (by weight) of 90/10 to 10/90:

(A) A conductive carbon black having an average particle size of 20 to 70 nm and an oil absorption defined in JIS K 5101 of 100 to 600 ml/100 g; and (B) A conductive carbon black in which the average article size ratio thereof to said conductive carbon black (A) is from 1.1 to 3, and the oil absorption ratio thereof to said conductive carbon black (A) is from 0.9 to 0.2, wherein the cross-sectional resistance value is from $10^8$ to $10^{12}$ Ω/cm, wherein the conductive fiber is a sheath-core type composite fiber, and wherein the sheath component contains the mixture of at least two kinds of carbon blacks (A) and (B) in an amount of 10 to 35% by weight.

6. A brush using the conductive fiber according to claim 5.

* * * * *